US006095020A

United States Patent [19]

Rinner

[11] Patent Number: 6,095,020

[45] Date of Patent: Aug. 1, 2000

[54] HAND TOOL HAVING A VARIABLE TORQUE-LIMITING IN-LINE DRIVE

[75] Inventor: James A. Rinner, Racine, Wis.

[73] Assignee: Beere Precision Medical Instruments, Inc., Racine, Wis.

[21] Appl. No.: 09/228,132

[22] Filed: Jan. 11, 1999

[51] Int. Cl.[7] ..... B25B 23/157

[52] U.S. Cl. ..... 81/475; 81/DIG. 5

[58] Field of Search ..... 81/473–476, DIG. 5

[56] References Cited

U.S. PATENT DOCUMENTS

| | | | |
|---|---|---|---|
| 2,733,622 | 2/1956 | Evans | 81/475 |
| 3,292,678 | 12/1966 | Noga | 81/475 |
| 4,063,474 | 12/1977 | Klopping | 81/474 |
| 4,272,973 | 6/1981 | Fu-Tsai | 81/475 X |
| 4,517,865 | 5/1985 | Huang | 81/475 |
| 4,653,359 | 3/1987 | Liao | 81/475 |
| 4,901,610 | 2/1990 | Larson et al. | 81/473 |

*Primary Examiner*—D. S. Meislin
*Attorney, Agent, or Firm*—Arthur J. Hansmann

[57] ABSTRACT

A hand tool of the type having a variable torque-limiting in-line drive with a handle having a cavity and a drive bit disposed in the cavity. Over-ride drive members are disposed in the cavity and a spring exerts a force on the drive members for transmitting only a maximum force to a bit in the tool. A variable control adjustment is on the tool and is used to apply a varying force to the spring and thus control the amount of maximum torque to be transmitted.

9 Claims, 4 Drawing Sheets

Fig. 4
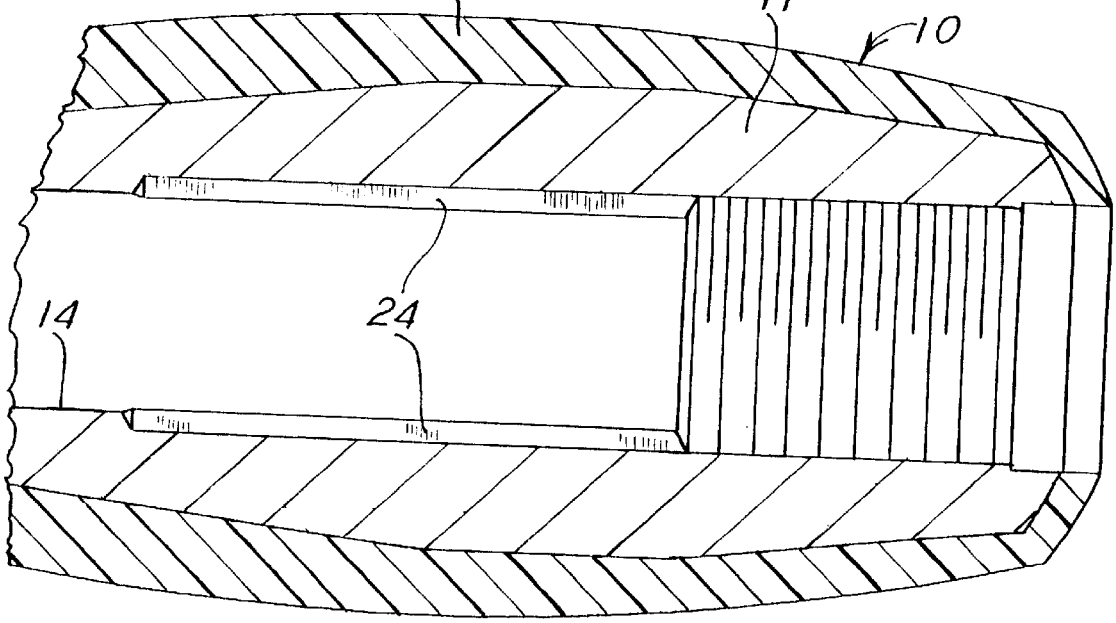
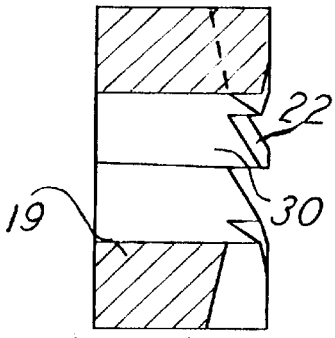
Fig. 15
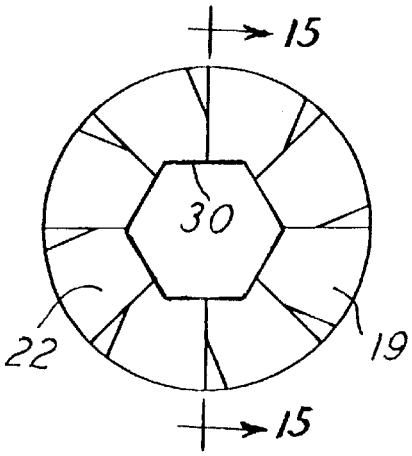
Fig. 14
Fig. 16
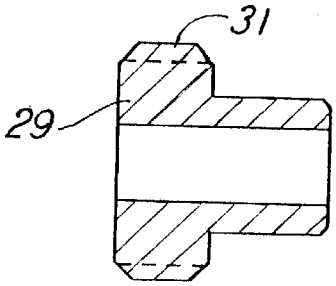
Fig. 17
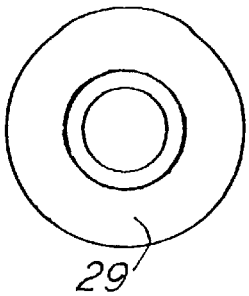

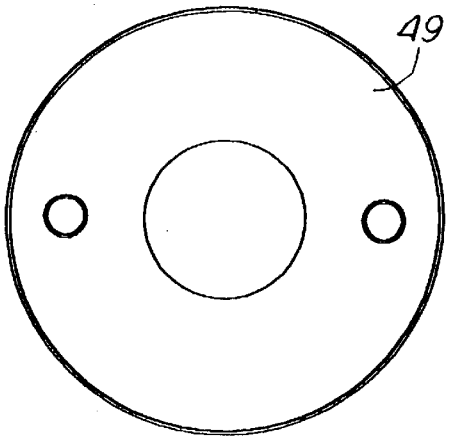
Fig.6
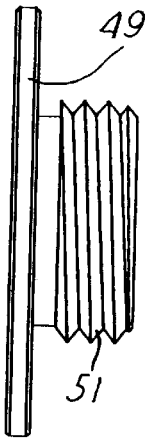
Fig.5
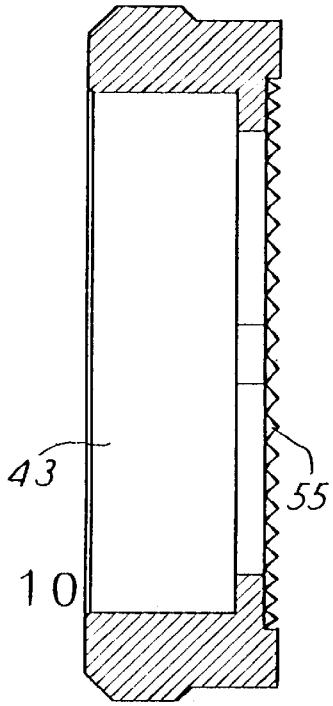
Fig.10
Fig.8
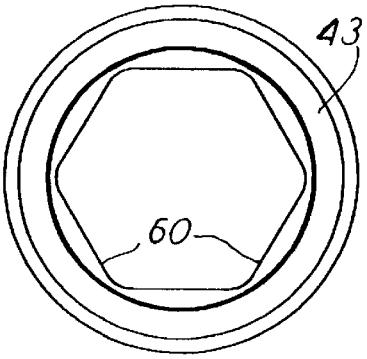
Fig.7
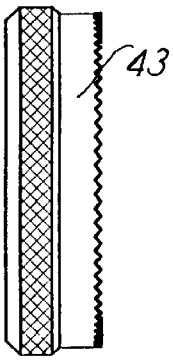
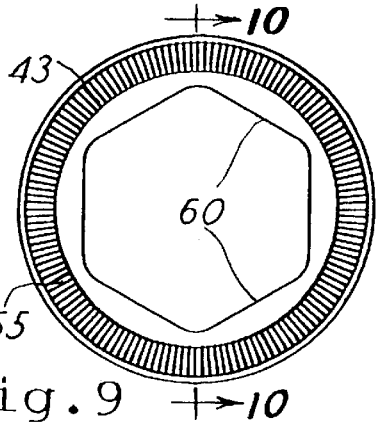
Fig.9
Fig.12
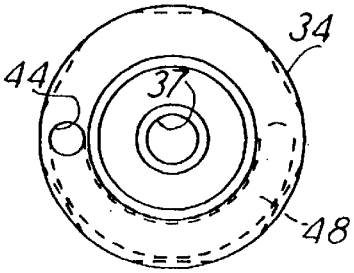
Fig.11
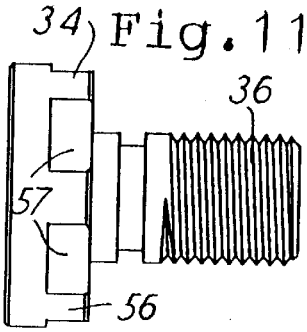
Fig.13
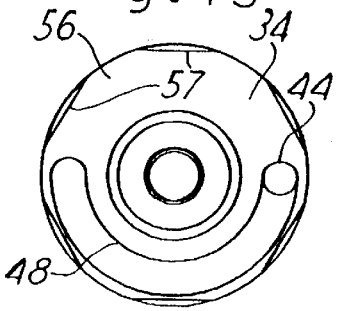

HAND TOOL HAVING A VARIABLE TORQUE-LIMITING IN-LINE DRIVE

This invention relates to a hand tool of the type having a variable torque-limiting in-line drive.

BACKGROUND OF THE INVENTION

Hand tools, such as screwdrivers with gear mechanisms, or the like, are commonly in use in various fields, including the medical instrument field where this invention is useful. Those tools have an elongated handle with gear-type teeth or the like within the handle and with a spring pressing on the teeth to hold the teeth in mutual engagement while the handle is being rotated to apply a torque to a work piece such as a screw. Also, in that arrangement, the gear teeth may be held together for a transmission therebetween of a maximum torque applied to the work piece Even further, the tool might have an adjustment which permits adjusting the force of the spring on the gear teeth to thereby adjust the maximum torque transmitted through the handle and to the work piece.

The present invention provides an adjustable control for applying selective forces on the gears or the like and doing so with a spring which forces on the gears in accord with the setting of the adjustable control.

Still further, the aforementioned adjustable control can have indicia thereon, such as graduation markings, so that the adjusted position of the control can be readily detected by the user and thus the control can be set in a desired position for effecting the desired spring force on the gears or those items which are transmitting the torque.

In that arrangement, it is desirable to have the adjustable control rotatable on the handle so that it can be set in the desired position but also have the control limited in its adjustable positioning so that it will operate exclusively within only a range of adjustment and not exceed its positioning to where it could actually become disconnected or otherwise fail in its operation. The entire arrangement is such that the operator can set the adjustable control to one of various selectable positions, and the operator can be assured that each time the control is set in that position that the desired maximum torque will be transmitted by the tool, and the transmitted torque will be limited to that one maximum amount in accord with that one setting for the adjustable control.

BRIEF DESCRIPTION OF THE DRAWINGS

FIG. 4 is an enlarged sectional view of a fragment of the handle as seen in FIG. 2.

FIGS. 5 and 6 are respectively enlarged side and end elevational views of a part shown in FIG. 2.

FIGS. 7, 8, and 9 are respectively side, left end, and right end views of a part shown in FIG. 2.

FIG. 10 is an enlarged sectional view of the part shown in FIGS. 7, 8, and 9, and taken on the plane designated 10—10 in FIG. 9.

FIGS. 11, 12, and 13 are respectively side, left, and right end views of a part shown in FIG. 2.

FIG. 14 is a right end view of a part shown in FIG. 2.

FIG. 15 is a sectional view taken on the plane designated 15—15 of FIG. 14.

FIG. 16 is the sectional view of a part shown in FIG. 2.

FIG. 17 is the right-end view of the part shown in FIG. 16, but in full view.

DETAILED DESCRIPTION OF THE PREFERRED EMBODIMENT

Figure 2:
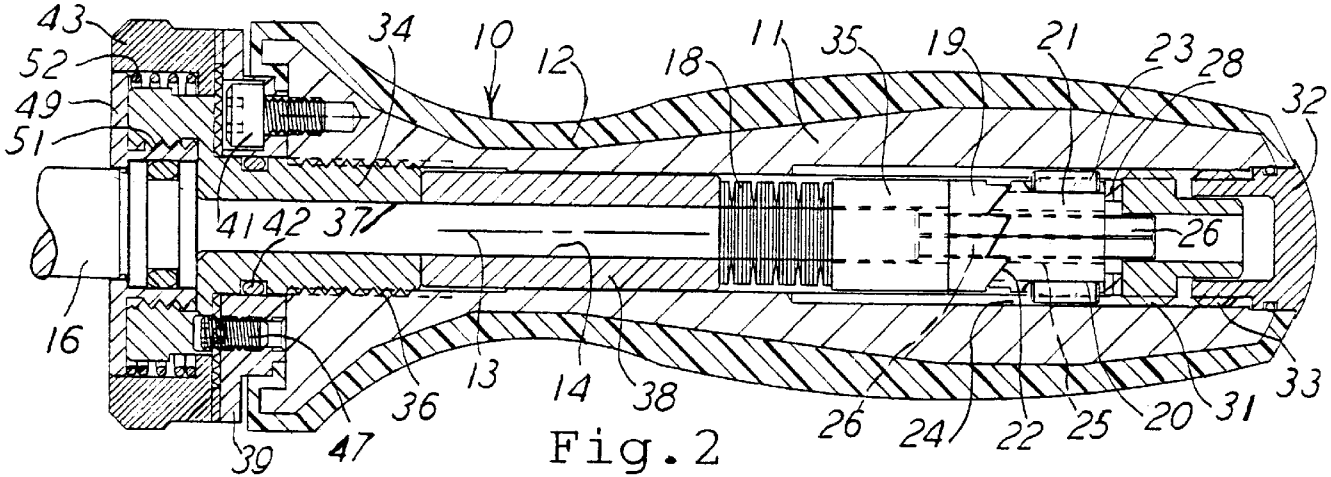
FIG. 2 is a longitudinal sectional view of the tool of FIG. 1.
Figure 3:
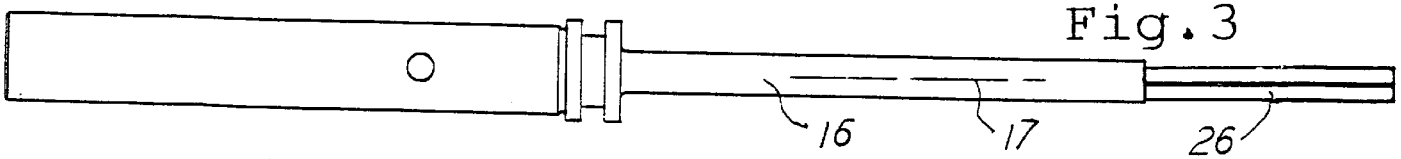
FIG. 3 is a side elevational view of the bit used in the tool.
Figure 1:
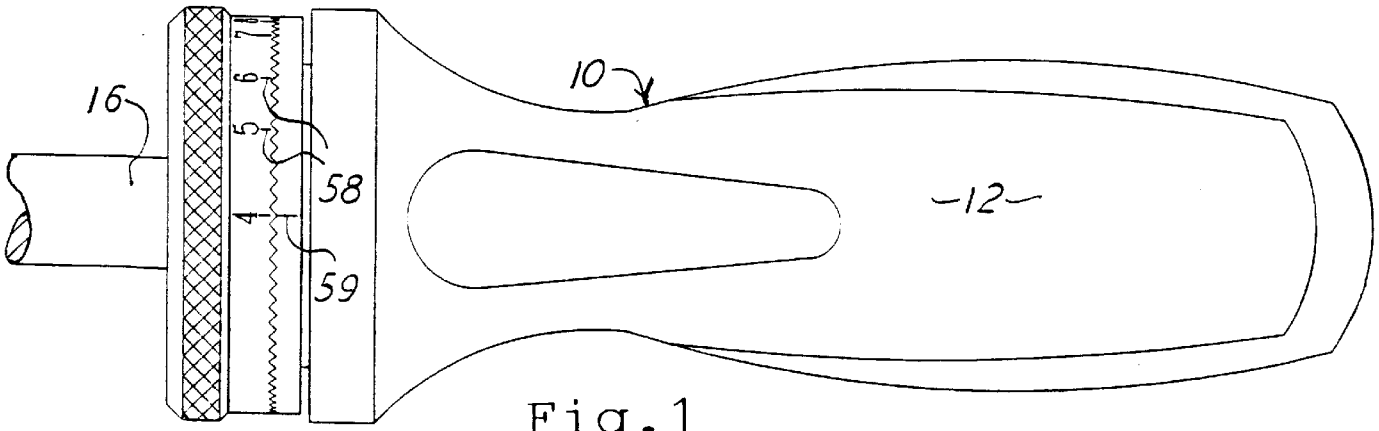
FIG. 1 is a side elevational view of the tool of this invention with a fragment of a bit therein.
Figure 20:
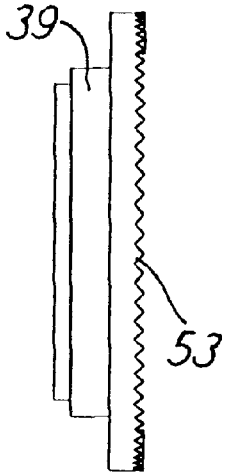
FIG. 20 is a left side view of FIG. 19.
Figure 19:
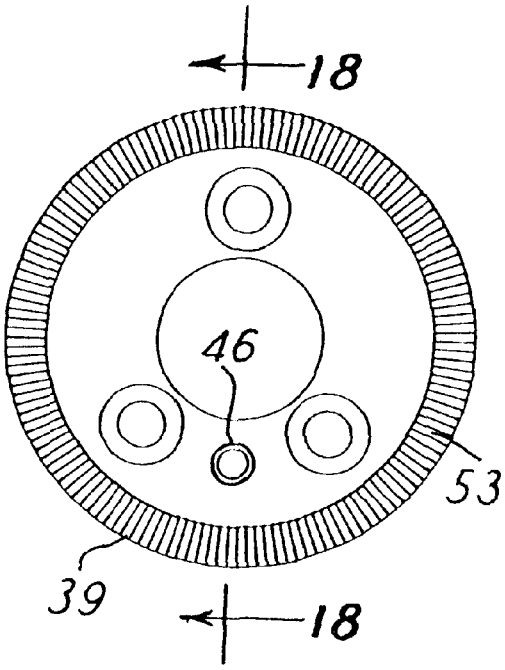
FIG. 19 is a left end view of the part shown in FIG. 18, and it shows the section plane 18—18 for FIG. 18.
Figure 18:
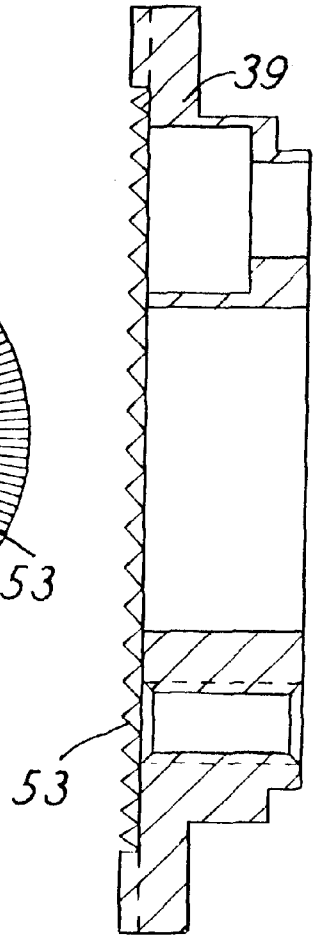
FIG. 18 is an enlarged sectional view of a part shown in FIG. 2.

FIGS. 1, 2, and 3 show the tool of this invention to include the handle, generally designated 10, having a core or body portion 11 and a cover portion 12 which may be a silicone or like resilient cover encapsulating the core 11. The handle 10 is shown elongated, and it has a longitudinal axis 13 and a longitudinal cavity 14 which extends co-axially with the axis 13. An elongated bit 16 can be inserted into the handle 10, and it has its own elongated axis 17 coaxial with the handle axis 13 to extend as fragmentarily shown in FIG. 2.

A plurality of annular belleville washers 18 are disposed within the cavity 14 and surround a length of the bit 16. As such, the washers 18 serve their usual purpose of being a spring which exerts a force along the axis 13, in the customary manner. Also coaxial with the bit 16 is a first gear member 19 and a second gear member 21, both of which are annular and are disposed within the cavity 14. The members 19 and 21 are the drive transmission members, and they have the interengaged teeth or ramps 22 disposed on each for rotation drive connection between the two members 19 and 21. In the arrangement shown, the member 21 can be in rotation drive relationship with the handle 10, such as by means of the pins 23 disposed in grooves 20 in the member 21 and engaged in suitable slots 24 in the handle core 11. That is, the arrangement is such that upon rotation of the handle 10 about its longitudinal axis 13 that rotation is transmitted to the pins 23 and likewise to the member 21. The rotation can be in either the clockwise or counter-clockwise direction about the longitudinal axis 13 and as viewed from the right end of FIG. 2, and, for purposes of further describing this invention, it is to be considered that the rotation is in the clockwise direction as viewed from the right-hand end of FIGS. 1 and 2. Also, the member 21 can move axially, and member 19 can too. Rotation of the handle 10 and the consequent similar rotation of the member 21 is transmitted to the member 19 when there is engagement at the ramps or teeth 22 which exist on both the members 19 and 21. Thus the member 19 will also rotate clockwise. The bit 16 is in relative non-rotative drive relationship with the member 21 in an arrangement such that when member 21 rotates, say clockwise, then the bit 16 is not directly driven by the member 21. That is, the bit 16 has a hexagonal cross-sectional end 26 which extends through an enlarged opening 25 in the member 21, and thus the member 21 and bit 16 are not driven directly together.

The bit hexagonal end 26 also extends through the member 19 and is in rotative drive relation with the member 19 which has a hexagonal opening 30 which snugly receives the bit hexagonal end 26, so the two rotate together. Accordingly, rotation of member 21 as driven by the handle 10 is transmitted to the member 19 by the ramps or teeth 22, and, in turn, that rotation is transmitted to the bit 16, as desired.

FIG. 2 further shows that there are thrust washers 28 surrounding the bit 16. An adjusting screw 29 is threaded into the handle core 11 by means of screw threads on the core 11 and mating screw threads on the member 29 and with those threads being at the mutual location 31. That is, the piece 29 is threaded into the handle cavity 14 and abuts the washers 28 which in turn abut the gear members 21 and 19 to cause the ramps or teeth 22 to be in non-sliding, or rotational drive, contact with each other up to a certain torque limit. A cylinder 35 is interposed between the member 19 and the spring 18 and transmits axial force therebetween.

It can now be seen and understood that the position of the piece 29 along the axis 13, such as established by the screw threads at 31, determines the force exerted on the spring 18 and thus determines the force between the angulated surfaces 22 of the members 19 and 21. Finally, there is an end cap 32 which also fits into the cavity 14 for closing the right end of the handle 10, and that cap can be threaded as at the thread indications at 33.

With just that portion of the aforementioned description, it will be understood by one skilled in the art that the rotation of the handle 10 will cause the same rotation of the member 21, and, when that rotation is transmitted through the ramp surfaces 22 which exist mutually on the members 19 and 21, then the member 19 will be rotationally driven to, in turn, rotate the bit 16. However, when the bit 16 meets the maximum torque setting of this tool, somewhat as explained in greater detail later, then the inclined or angulated surfaces 22 will simply slide past each other, and the bit 16 will not be rotated. Thus, the maximum transmitted torque has been established, as desired. The aforementioned is conventional.

The left end of FIG. 2 shows the preferred arrangement for varying the force exertable by the spring 18 on the members 19 and 21. An adjustment shaft 34 has threads and is shown threaded into the cavity 14 of the handle core 11 as at 36. Of course the shaft 34 has a longitudinally extending axial opening 37 through which the bit 16 extends, as shown. Also, there is a cylinder 38 disposed in the cavity 14 and it extends from the spring 18 and to the shaft 34 to communicate the force transmitted between the shaft 34 and the spring 18.

Initially, a locking ring 39 is secured to the end of the core 11 by means of screws 41 passing therethrough and into the core 11, as shown. Before shaft 34 is screwed into the core 11, O-ring 42 is placed on the shaft 34. Also, a locking collar 43 is positioned over the end of the shaft 34 as shown in FIG. 2. That sub-assembly including the shaft 34 and the collar 43 are then positioned as seen in FIG. 2.

FIGS. 12 and 13 show that the adjustment shaft 34 has an opening 44 which can be aligned with a threaded opening 46 in the locking ring 39. Thus, a set screw 47 is inserted through the opening 44 and is threaded into the opening 46 but extends therefrom into FIGS. 12 and 13 shown 180 degree groove 48 in the adjustment shaft 34, and as seen in FIG. 2.

A locking ring 49 is threaded connected at 51 with the adjustment screw 34. A compression spring 52 is disposed between the locking ring 49 and the adjusting screw 34. Thus, the locking collar 43 is urged rightward, as viewed in FIG. 2, to where it is in contact with the locking ring 39.

The locking ring 39 and the locking collar 43 respectively have intervening serrations or teeth 53 and 55 such that, when in the position shown in FIG. 2, there is no relative rotation between the locking members 39 and 43. Also, the adjustment shaft 34 is shown to be generally T-shaped, and it has a head 56 which presents peripherally disposed flats 57 on the exterior thereof, such as seen in FIGS. 11, 12, and 13. Similarly, the locking collar 43 has flats 60 which are also in the hexagonal pattern as seen in FIGS. 8 and 9, and they extend around the interior of collar 43 and are arranged in snug and sliding contact with the shaft flats 57. That matching arrangement always exists so that the collar 43 can slide left and right relative to the shaft 34 but will always remain in rotational drive relationship with the shaft 34. That is, the collar 43 can be disengaged from the locking ring 39 and it will still rotate the shaft 34 when the collar 43 is rotated, and that produces the variable adjustability for creating the force on the spring 18. Of course, the rotation of the collar 43 is produced by the operator's fingers engaged with the knurled surface on the circumference of the collar 43, as seen in FIG. 7.

FIG. 1 shows that the locking collar 43 has gradation markings or indicia designated 58 as indicated by the example of those numbers shown and ranging from "4" to "8", as they are shown in FIG. 1, for instance. That is, the collar 43 can be rotated to where one of the selected graduation numbers or indicia aligns with a mark or indicia 59 on the handle 10, and thus the rotated position of the adjustment shaft 34 is then apparent to the user. Of course that adjustment control described is all on the exterior of the tool and is thus readily available to the user for setting in the desired position and thereby placing the desired axial force on the spring 18 and thus on the torque transmission surfaces 22, as described.

With the 180 degree extension of the arcuate groove 48, the adjustment shaft 34 cannot be over-positioned with regard to its rotational adjustment described, and the set screw 47 serves as a stop extending into the limit groove 48.

Throughout all of this, it will now be seen that there is variable control for setting the force on the spring and thus the force on the members which transmit torque through the tool. Also, because the operating elements are coaxial with the axis 13, this is an in-line type of torque-limiting tool.

The indicia 58 and 59 serves as a dial for the operator to control the setting and thus the force exerted by the spring 18. Before the variable adjustment is established through the adjusting shaft 34, as described, the tool can be calibrated through the application of the threaded adjuster 29 which initially places force on the spring 18. Beyond that, the variable adjustment, as shown at the left end of FIG. 2, is limited to be within a desireable range and is achieved entirely externally of the tool, that is, as an on-site adjustment, and without the need of any other tools.

What is claimed is:

1. In a hand tool of the type having a variable torque-limiting in-line drive having a handle with a longitudinal axis and a cavity extending along said axis, an elongated drive bit disposed in said cavity and extending from said handle for engaging an object to be rotationally driven by said tool, two gears disposed in said cavity and having a common central axis co-axial with said longitudinal axis and said gears having teeth thereon in mesh between said gears on a plane transverse to said central axis and said gears being arranged for rotation of one of said gears about said central axis in one direction of rotation and relative to the other of said gears and to preclude rotation of said one gear in a rotation direction opposite said one direction, said bit being rotationally connected to said one gear and said one gear being rotationally connected to said handle for rotation of said bit upon rotation of said handle, a spring in said cavity and being operative on said one gear for yieldingly urging said one gear into mesh with the other of said two gears to thereby limit the rotation torque transmitted between said two gears in said one direction, and an adjustable control in said cavity and operative on said gears in the direction along said central axis for applying axial force on said gears to establish the limit of rotation torque transmitted between said gears to said bit, the improvement comprising an additional adjustable control movably mounted on said handle and extending externally of said handle whereby said additional control is accessible exteriorly of said handle, said additional adjustable control includes an adjuster threadedly operative for rotational movement on said axis and relative to said handle and extends into contact with said spring and thereby forces on said spring for pressing said gears toward each other, said adjustable control also includes a portion selectively rotatable on said axis and which is always in rotational driving relationship with said adjuster and is releasably non-rotationally secured to said handle in a first position and is movable along said axis to a second position which is of rotational release relative to said handle, a spring operative on said portion to urge said portion into said first position to be rotationally secured with said handle, a rotation drive connection between said portion and said adjuster for transmitting rotational force from said portion to said adjuster in said second position of said portion, and interconnections between said portion and said handle whereby said portion is non-rotationally releasably secured in selected rotated positions relative to said handle when under the influence of only said spring which is operative on said portion.

2. The hand tool having a variable torque-limiting in-line drive as claimed in claim 1, including marking indicia on said handle and on said portion and being coordinated therebetween whereby the adjustably moved position of said portion is visibly evident in accord with the said marking indicia on said handle.

3. The hand tool having a variable torque-limiting in-line drive as claimed in claim 1, including a rotation stop on said handle and extending into engagement with said adjuster whereby the degree of rotation of said additional adjustable control on said handle is limited.

4. A hand tool having a variable torque-limiting in-line drive comprising a handle having a longitudinal axis and a longitudinally disposed end and a cavity extending along said axis, an elongated drive bit disposed in said cavity and extending along said axis and from said handle for engaging an object to be rotationally driven by said tool, two rotation drive members arranged to transmit rotation therebetween and being disposed in said cavity and with one of said members being in rotation drive with said handle and the other of said members being in rotation drive with said bit and axially movable therealong, interengagable surfaces on said members for effecting the transmission of rotation therebetween, said rotation members being supported in said cavity to be relatively movable away from each other in a direction transverse to the plane of rotation of said members to a position of disengagement of said surfaces in response to maximum torque being transmitted therebetween and to thereby preclude rotation between said members, a spring in said cavity and being operative on said members for yieldingly urging said members axially of said bit in said direction into position of engagement of said surfaces to establish the maximum torque transmitted between said two members, an adjustable control on said handle end and having an adjuster threaded onto said handle and rotatable thereon and operative on said spring in said direction whereby force is applied on said members through said spring to establish the maximum torque transmitted between said members to said bit, said adjuster being threaded into said cavity in said handle on said axis and arranged to rotate in said cavity to thereby move along said axis transverse to said plane and toward and away from said spring in establishing the torque to be transmitted between said members, said adjustable control includes a portion selectively movable in a direction of movement toward said handle and along said axis and relative to said adjuster to a first position, and being non-rotatable on said handle in said first position, and said portion being selectively movable in a direction of movement away from said handle and along said axis and relative to said adjuster to a second position, and being rotatable on said handle in said second position, said portion being in rotational drive relationship with said adjuster throughout all said movement and both said first and said second positions of said portion, whereby all rotated positions of said portion establish the identical rotated positions of said adjuster, and a rotation stop on said handle and extending into engagement with said portion whereby the degree of rotation of said portion on said handle is limited.

5. The hand tool having a variable torque-limiting in-line drive as claimed in claim 4, including matching marking indicia on said portion and said handle and being arranged to indicate the rotational position of said portion relative to said handle.

6. The hand tool having a variable torque-limiting in-line drive as claimed in claim 4, wherein said rotation stop consists of an arcuate slot and a projection respectively on said portion and said handle and with said projection disposed in said slot for limiting rotation of said portion to the arcuate length of said arcuate slot.

7. The hand tool having a variable torque-limiting in-line drive as claimed in claim 4, including serrations respectively on said portion and said handle and disposed to be in mutual contact therebetween when said portion is disposed in said first position toward said handle, and thereby provide for the non-rotation of said portion relative to said handle.

8. The hand tool having a variable torque-limiting in-line drive as claimed in claim 4, wherein said portion is a ring encircling said axis and its movement toward and away from said handle is along said axis, a spring interposed between said handle and said ring for yeildingly urging said ring toward said handle and into said first position, and said portion and said adjuster having a rotation drive connection operative therebetween during all axial positions of said portion.

9. The hand tool having a variable torque-limiting in-line drive as claimed in 8, including serrations interengagable between said handle and said portion in said first position and engaged therebetween with the precision of only several angular degrees of rotation in accord with the rotated positions of said portion on said handle.

* * * * *